US010355421B2

(12) United States Patent
Zhao

(10) Patent No.: US 10,355,421 B2
(45) Date of Patent: Jul. 16, 2019

(54) ELECTRICAL CONNECTOR HAVING SHARED GROUND CONTACT TAIL PORTION

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/860,644

(22) Filed: Jan. 2, 2018

(65) Prior Publication Data

US 2018/0191106 A1 Jul. 5, 2018

(30) Foreign Application Priority Data

Dec. 30, 2016 (CN) ..... 2016 2 1492812 U

(51) Int. Cl.

| | |
|---|---|
| ***H01R 13/6594*** | (2011.01) |
| ***H01R 13/6585*** | (2011.01) |
| ***H01R 13/6597*** | (2011.01) |
| *H01R 107/00* | (2006.01) |
| *H01R 24/60* | (2011.01) |

(Continued)

(52) U.S. Cl.

CPC ..... *H01R 13/6594* (2013.01); *H01R 13/6585* (2013.01); *H01R 13/6597* (2013.01); *H01R 12/724* (2013.01); *H01R 13/6587* (2013.01); *H01R 24/60* (2013.01); *H01R 2107/00* (2013.01)

(58) Field of Classification Search

CPC ..... H01R 13/6587; H01R 13/6594; H01R 23/6873; H01R 23/7073; H01R 23/02; H01R 24/60; H01R 24/62

USPC ..... 439/660, 676, 607.4

See application file for complete search history.

(56) References Cited

U.S. PATENT DOCUMENTS

| | | | | |
|---|---|---|---|---|
| 8,851,927 | B2 * | 10/2014 | Hsu | H01R 12/724 439/607.11 |
| 9,634,409 | B2 * | 4/2017 | Tsai | H01R 12/724 |
| 2016/0359274 | A1 | 12/2016 | Zhang et al. | |

FOREIGN PATENT DOCUMENTS

| | | |
|---|---|---|
| CN | 204118317 U | 1/2015 |
| CN | 104810657 A | 7/2015 |
| CN | 105024197 A | 11/2015 |

(Continued)

*Primary Examiner* — Abdullah A Riyami
*Assistant Examiner* — Justin M Kratt
(74) *Attorney, Agent, or Firm* — Wei Te Chung; Ming Chieh Chang

(57) ABSTRACT

An electrical connector includes: an insulative housing having a base and a tongue; an upper and lower rows of contacts arranged in the insulative housing and exposed respectively to an upper and lower surfaces of the tongue, each row of contacts including an outermost ground contact, the ground contact in the lower row having a contacting portion, a tail portion, and an intermediate portion between the contacting portion and the tail portion; a metallic element arranged between the upper row of contacts and the lower row of contacts; and a shielding shell enclosing the insulative housing; wherein the ground contact in the upper row and the ground contact in the lower row are in contact with the metallic element; and the ground contact in the upper row and the ground contact in the lower row share same tail portion of the ground contact in the lower row.

12 Claims, 13 Drawing Sheets

(51) Int. Cl.
*H01R 13/6587* (2011.01)
*H01R 12/72* (2011.01)

(56) References Cited

FOREIGN PATENT DOCUMENTS

| | | | |
|---|---|---|---|
| CN | 105552618 | A | 5/2016 |
| CN | 205790740 | U | 12/2016 |

* cited by examiner

ELECTRICAL CONNECTOR HAVING SHARED GROUND CONTACT TAIL PORTION

BACKGROUND OF THE INVENTION

1. Field of the Invention

The present invention relates to an electrical connector having an upper ground contact in an upper row of contacts and a lower ground contact in a lower row of contacts that are respectively in contact with two opposite faces of a middle metallic plate, wherein one of the upper and lower ground contacts lacks a soldering or tail portion.

2. Description of Related Arts

It is known for Universal Serial Bus (USB) Type-C connectors to have ground contacts in an upper and lower rows of contacts be in contact with a middle metallic plate, wherein each of the ground contacts in the upper and lower rows has its own tail portion.

SUMMARY OF THE INVENTION

An electrical connector comprises: an insulative housing having a base and a tongue; an upper and lower rows of contacts arranged in the insulative housing and exposed respectively to an upper and lower surfaces of the tongue, each row of contacts including an outermost ground contact, the ground contact in the lower row having a contacting portion, a tail portion, and an intermediate portion between the contacting portion and the tail portion; a metallic element arranged between the upper row of contacts and the lower row of contacts; and a shielding shell enclosing the insulative housing; wherein the ground contact in the upper row and the ground contact in the lower row are in contact with the metallic element; and the ground contact in the upper row and the ground contact in the lower row share same tail portion of the ground contact in the lower row.

DETAILED DESCRIPTION OF THE PREFERRED EMBODIMENT

Figure 1:
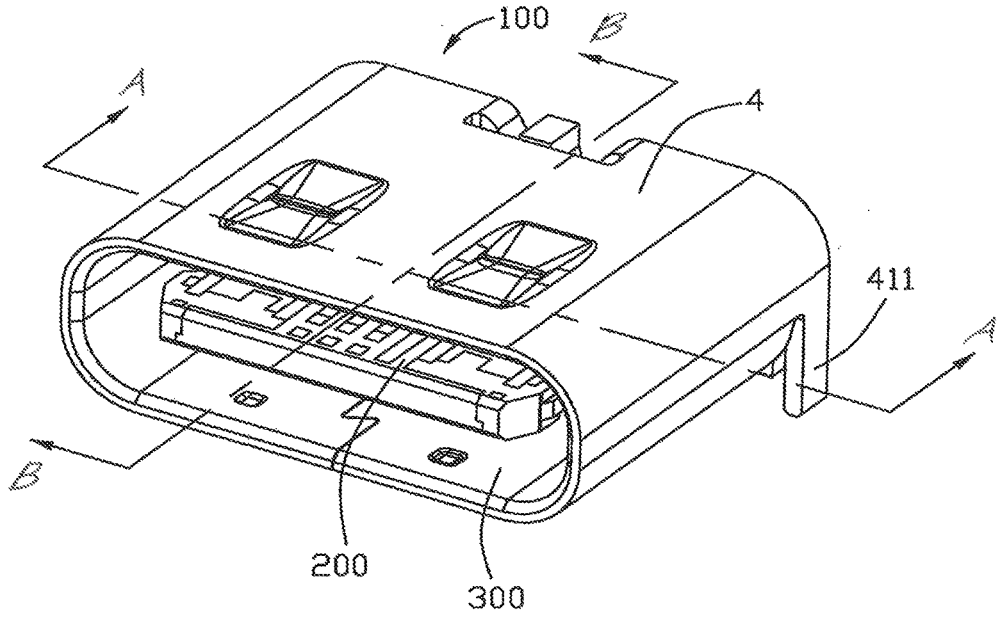
FIG. 1 is a perspective view of an electrical connector in accordance with the present invention.
Figure 2:
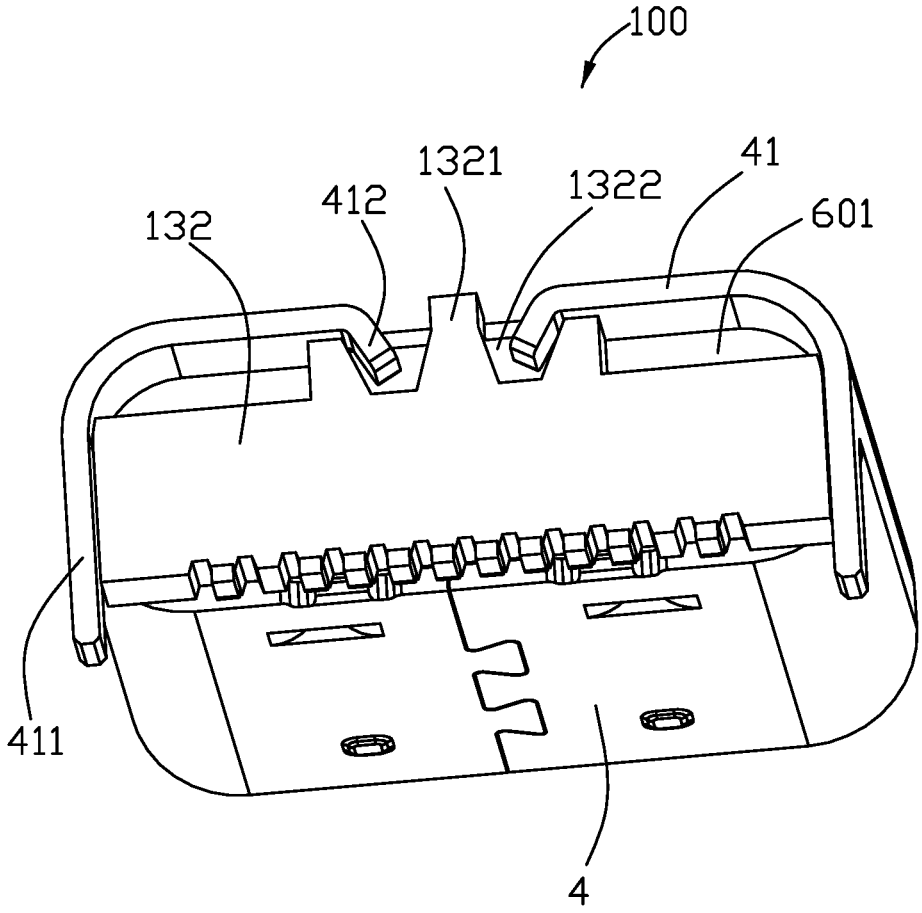
FIG. 2 is another perspective view of the electrical connector.

Referring to FIGS. 1-11, an electrical connector 100 comprises a contact module 200 and a shielding shell 4 enclosing the contact module 200. The electrical connector 100 may further comprise a rear sealing element 5. The contact module 200 includes an insulative housing 1, two rows of contacts 2 arranged in the insulative housing 1, and a metallic element 3 arranged in the insulative housing 1 between the two rows of contacts 2.

Referring specifically to FIGS. 3-9, the insulative housing 1 includes a base 11 and a tongue 12. The insulative housing 1 is constructed of a first insulator 13 that is insert molded with the contacts 2 and a second insulator 14 that is further over-molding the insert-molded first body and contacts. The first insulator 13 has a base part 130 and a tongue part 133. The base part 130 has a front portion 131, a rear portion 132, and a gap 134 dividing the front and rear portions. There are three blocks 1321 at the rear portion 132 and two slots 1322 between the blocks 1321. The tongue portion 133 has a void space 1331. The second insulator 14 fills up the void space 1331. The tongue part 133 and the second insulator 14 constitute the tongue 12 of the insulative housing 1. The base part 130 of the first insulator 13 constitutes the base 11 of the insulative housing 1.

Figure 10:
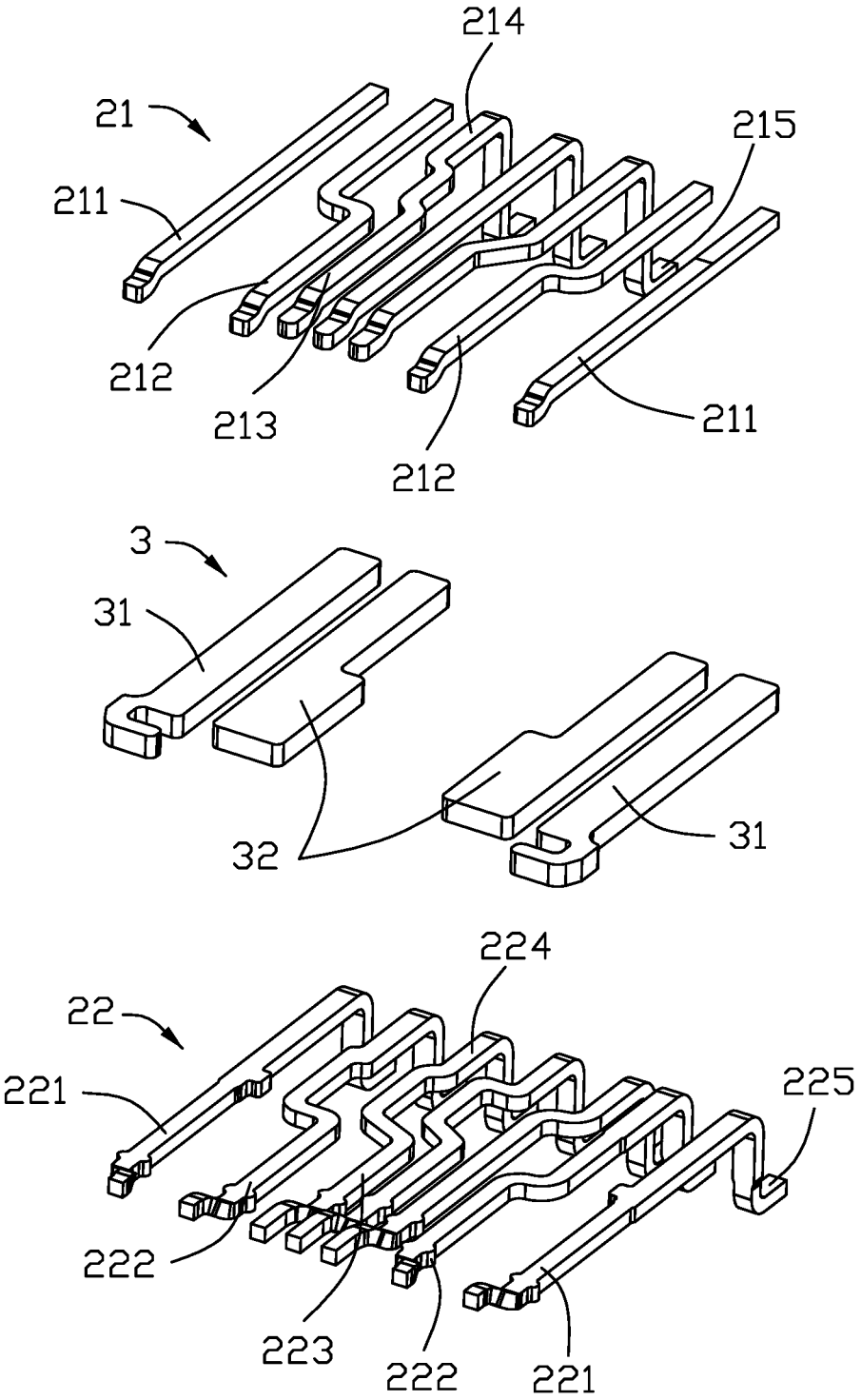
FIG. 10 is an exploded view of two rows of contacts and a metallic element of the contact module.
Figure 11:
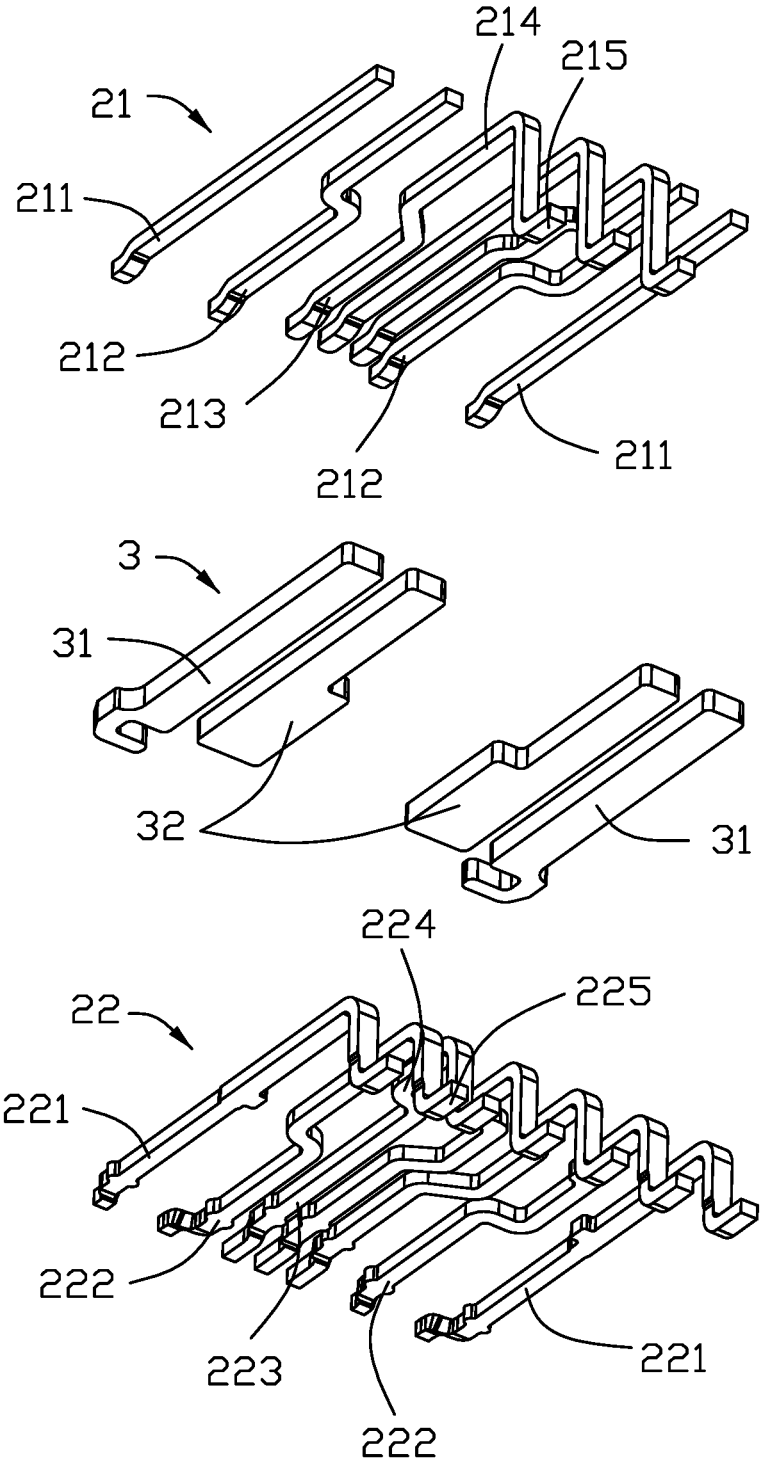
FIG. 11 is a view similar to FIG. 10 but from a different perspective.
Figure 12:
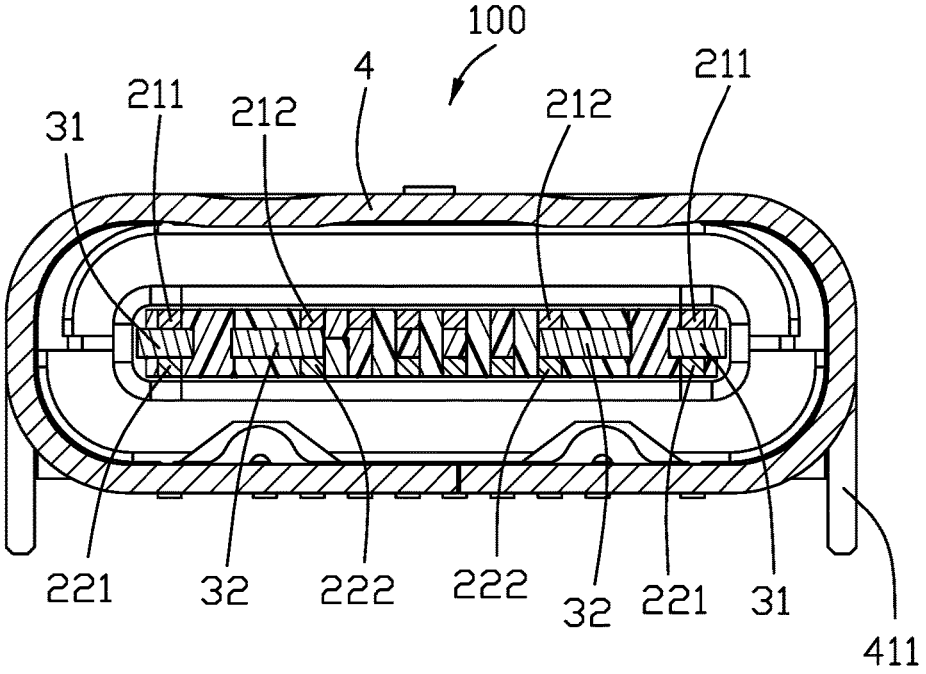
FIG. 12 is a cross-sectional view of the electrical connector taken along line A-A in FIG. 1.
Figure 13:
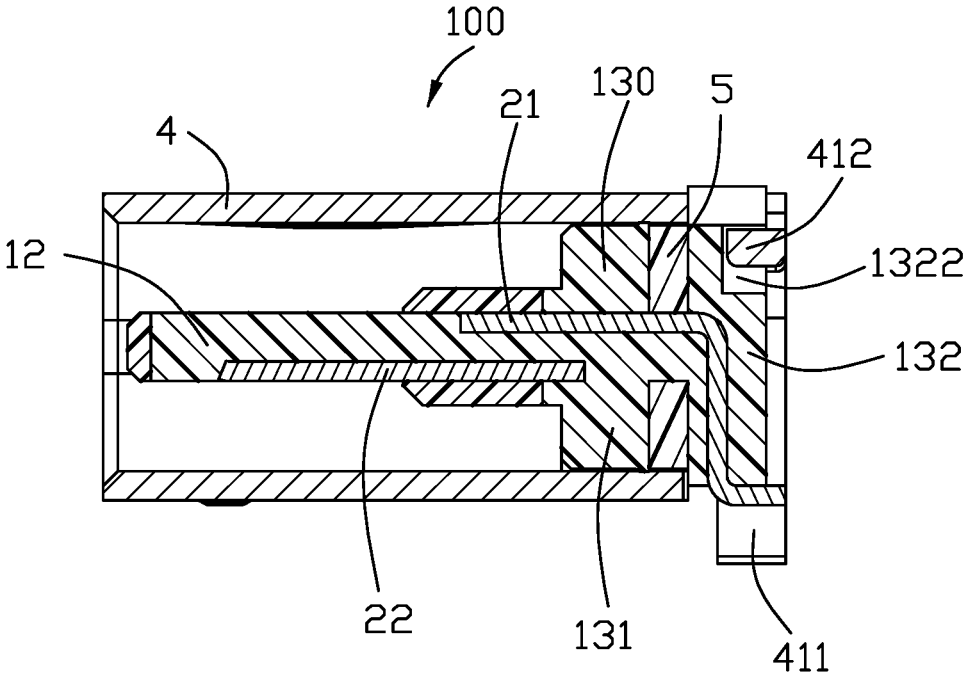
FIG. 13 is a cross-sectional view of the electrical connector taken along line B-B in FIG. 1.

Referring specifically to FIGS. 10-11, the plurality of contacts 2 include an upper row of (upper) contacts 21 and a lower row of (lower) contacts 22 so designed and arranged in number and in function that the electrical connector 1 may support mating of a complementary plug connector in either of two orientations.

The upper row of contacts 21 include two outermost ground contacts 211, two power contacts 212 next to the two ground contacts 211, and plural signal contacts. Each of the signal contacts in the upper row has a front contacting section or portion 213, a rear soldering section or tail portion 215, and an intermediate portion 214 between the contacting portion 213 and the tail portion 215. Each of the ground contacts 211 and the power contacts 212 lacks a tail portion. The lower row of contacts 22 include two outermost ground contacts 221, two power contacts 222 next to the two ground contacts 221, and plural signal contacts. Each of the contacts 22 has a contacting portion 223, a tail portion 225, and an intermediate portion 224 between the contacting portion 223 and the tail portion 225. The tail portions 215 and 225 of the contacts 21 and 22 are arranged in a line. A distance between the tail portions of the ground contact 221 and the neighboring power contact 222 is greater than a distance between the tail portions of two adjacent signal contacts.

The metallic element 3 includes a pair of outer first plates 31 and a pair of inner second plates 32 next to the first plates 31.

Figure 3:
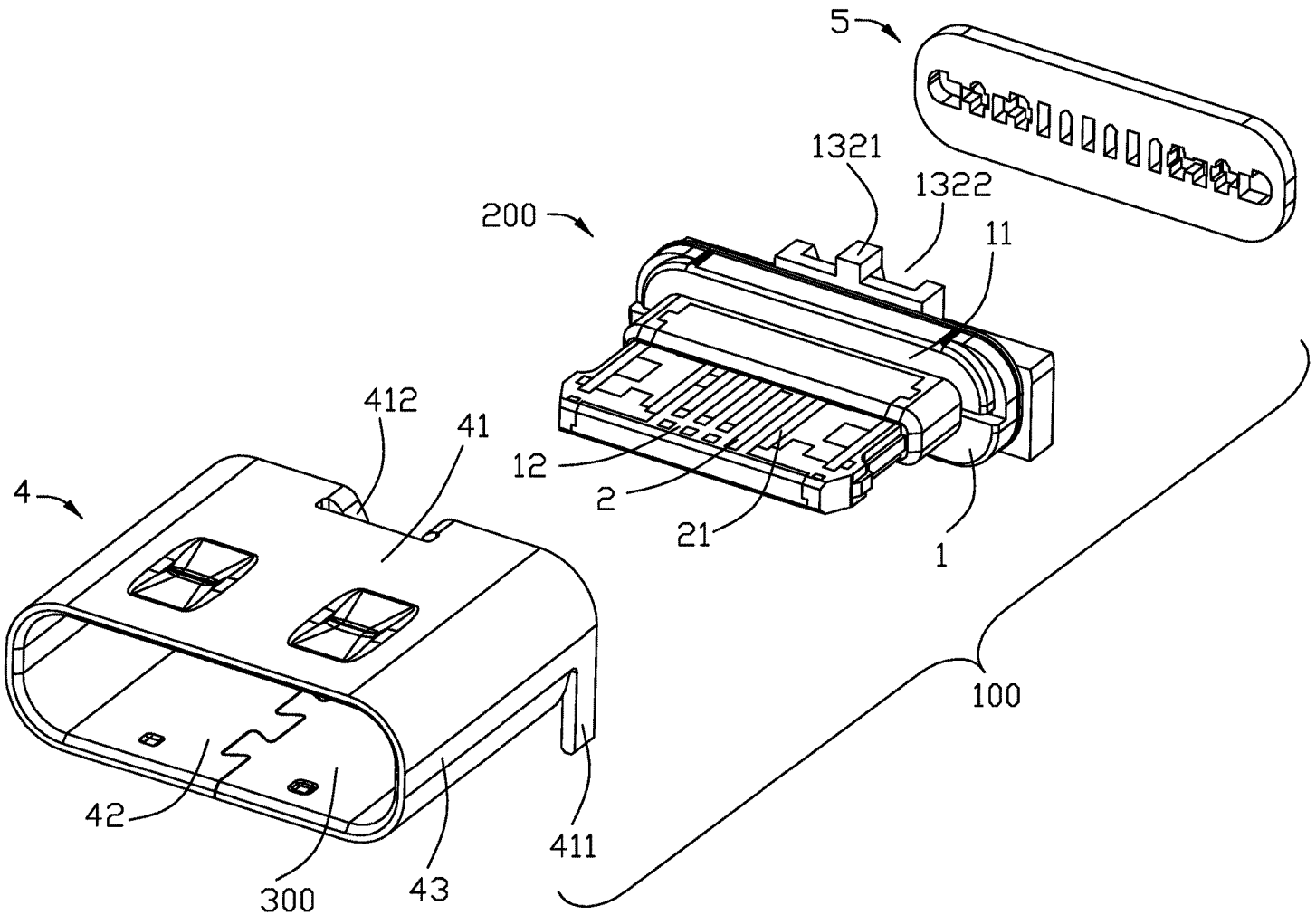
FIG. 3 is an exploded view of the electrical connector.
Figure 4:
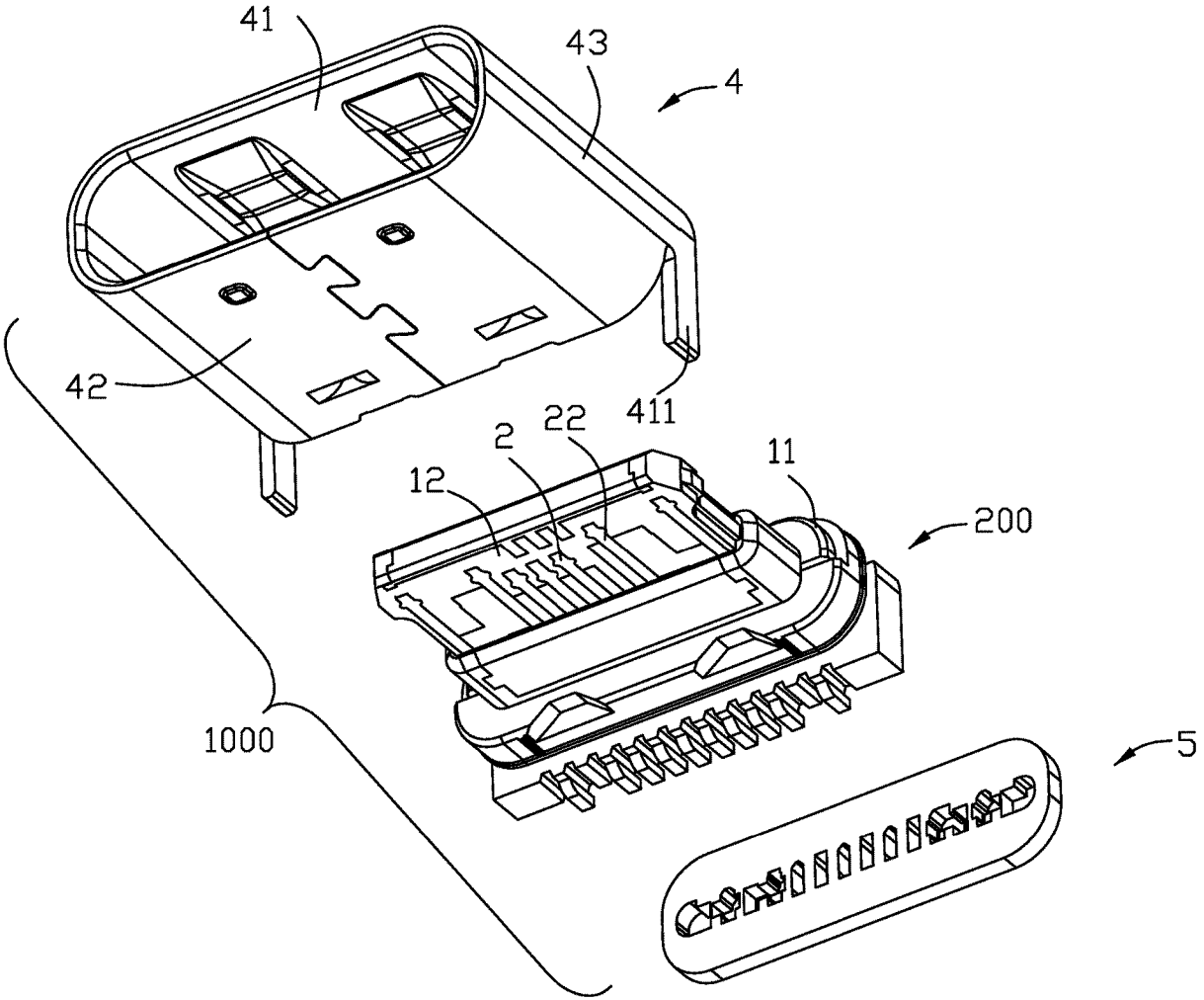
FIG. 4 is another exploded view of the electrical connector.
Figure 5:
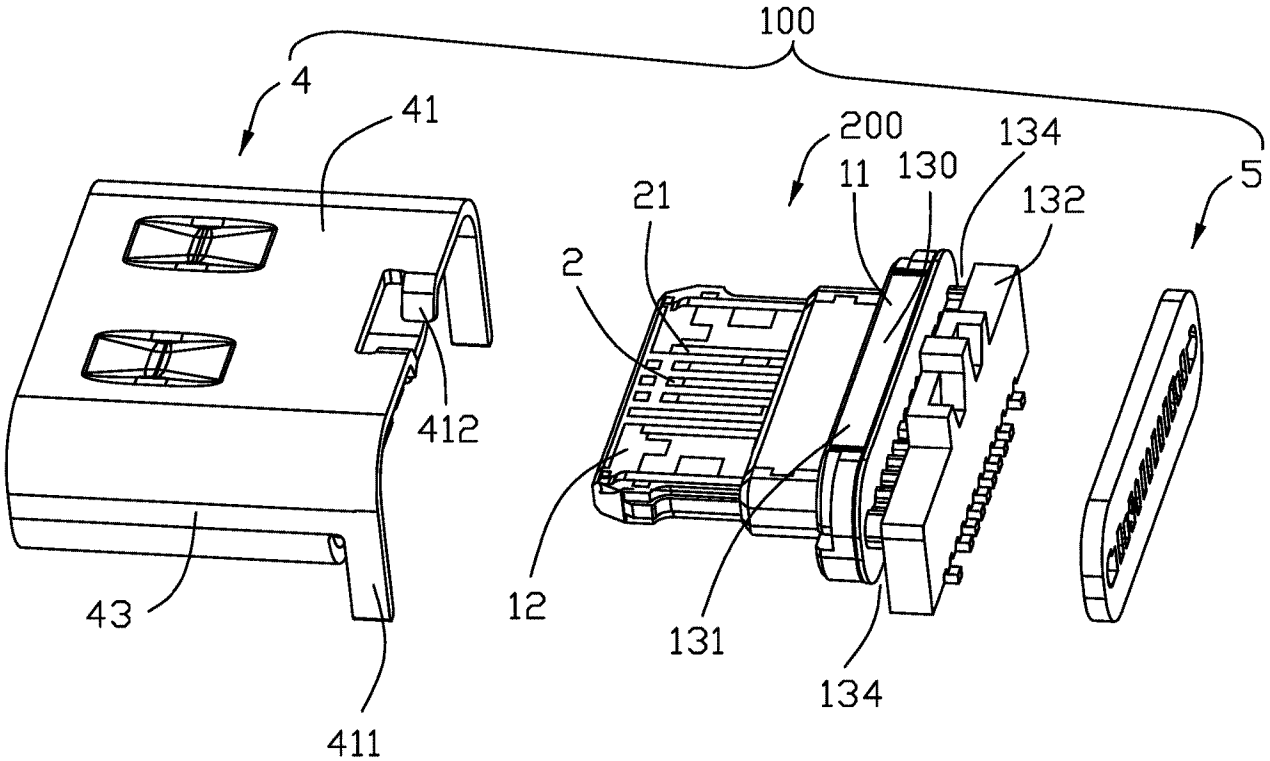
FIG. 5 is a further exploded view of the electrical connector.
Figure 6:
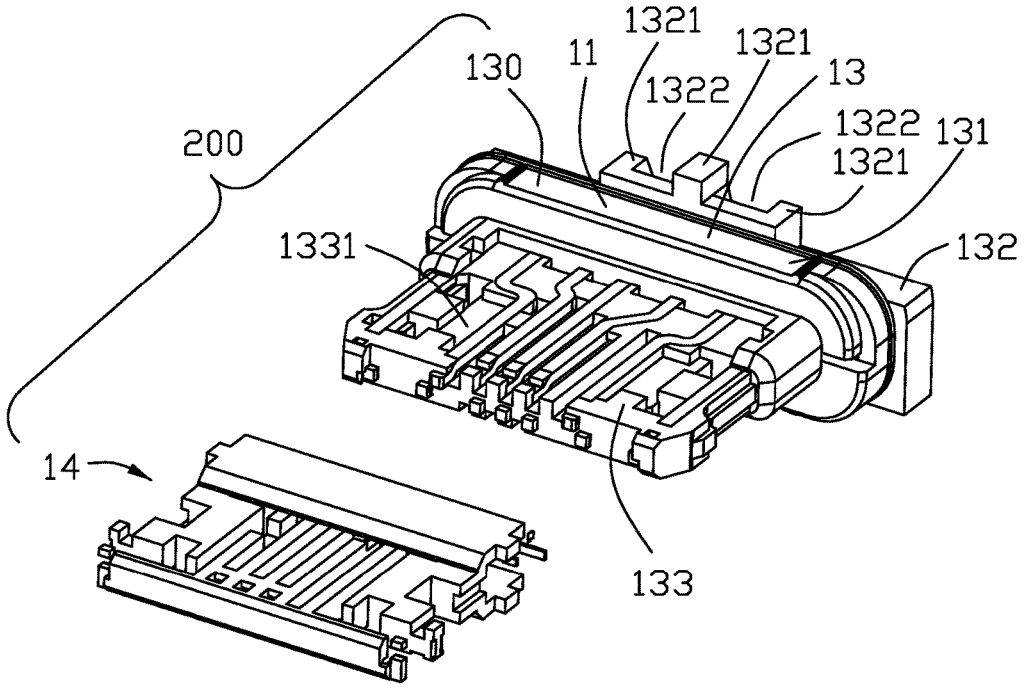
FIG. 6 is an exploded view of a contact module of the electrical connector.
Figure 7:
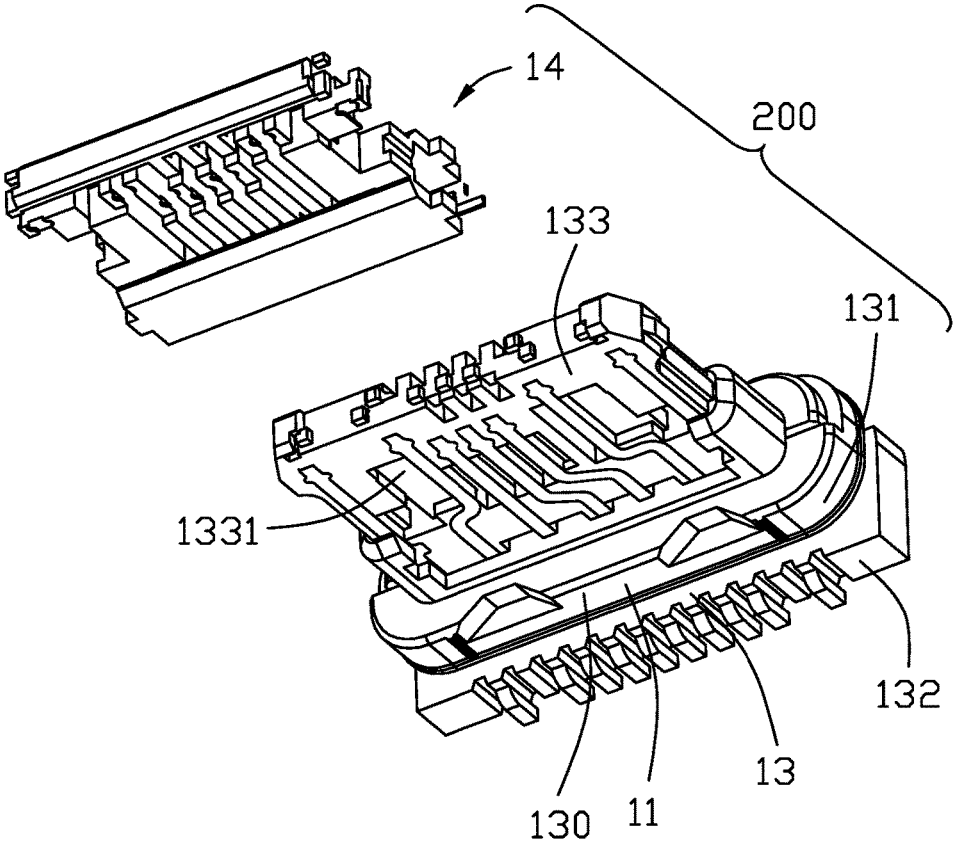
FIG. 7 is a view similar to FIG. 6 but from a different perspective.
Figure 8:
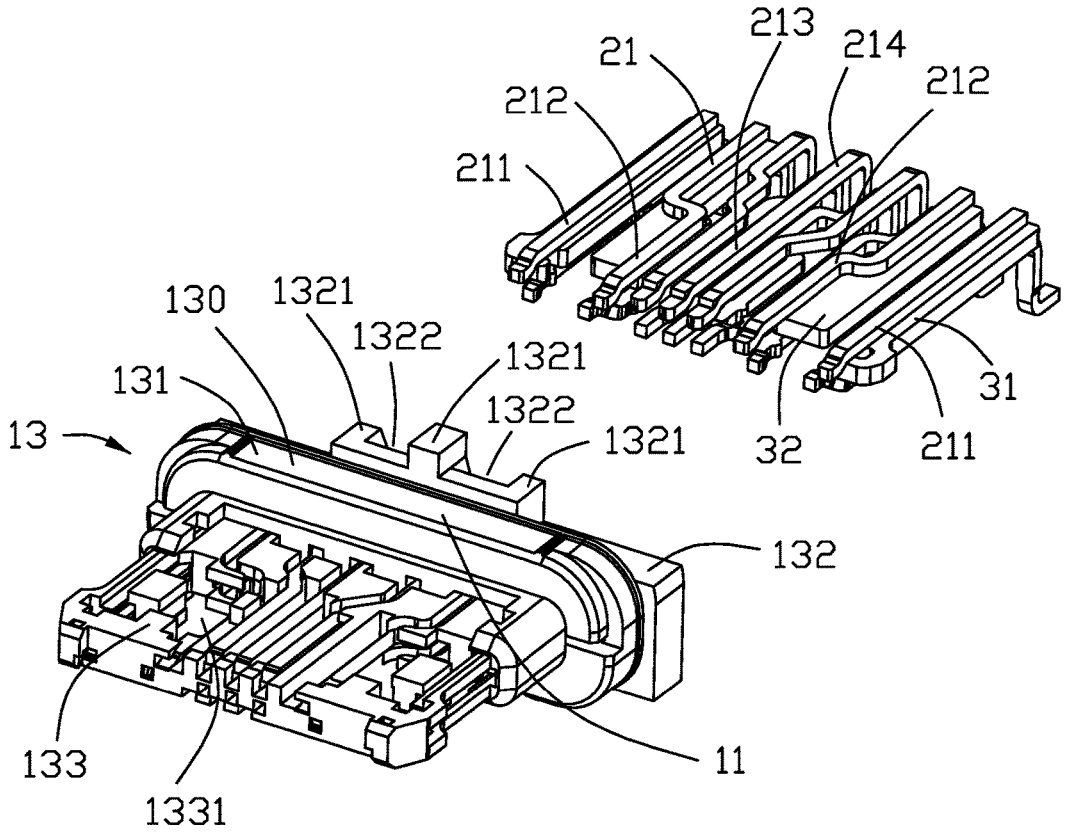
FIG. 8 is a further exploded view of the contact module omitting an over-mold thereof.
Figure 9:
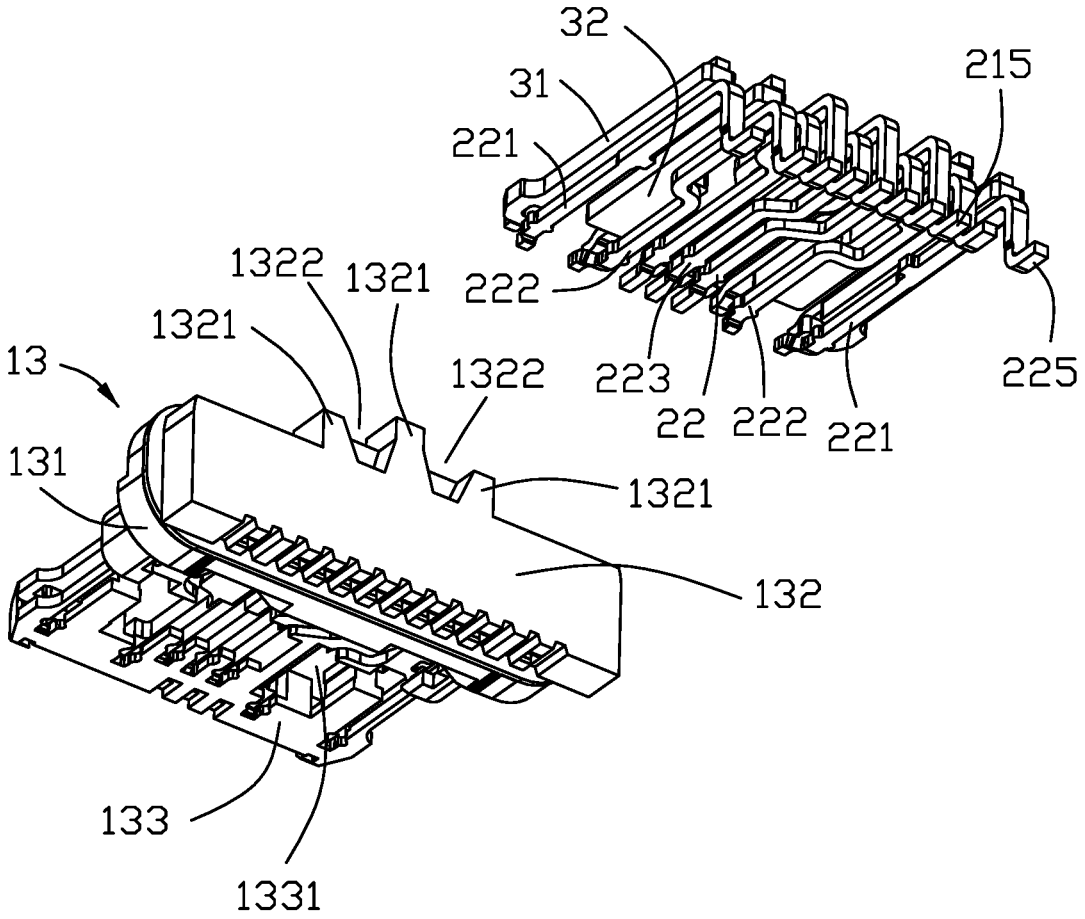
FIG. 9 is a view similar to FIG. 8 but from a different perspective.

Referring specifically to FIGS. 3-4, the shielding shell 4 has a top wall, a bottom wall 42, and a pair of side walls 43 surrounding a receiving space 300. The top wall 41 has a pair of fixing legs 411 and a pair of fixing tabs 412.

The upper and lower rows of contacts 21 and 22 are arranged in the insulative housing 1 and exposed respectively to an upper and lower surfaces of the tongue 12. The metallic element 3 is arranged between the upper row of contacts 21 and the lower row of contacts 22 and moreover the ground contact 211 in the upper row and the ground contact 221 in the lower row are in contact with the first plate 31. More particularly, the ground contact 211 in the upper row and the ground contact 221 in the lower row share same tail portion 225 of the ground contact 221 in the lower row.

Similarly, the power contact 212 in the upper row and the power contact 222 in the lower row are in touch with the second plate 32 so that the power contact 212 in the upper row and the power contact 222 in the lower row share same tail portion 225 of the power contact 222 in the lower row.

After the contact module 200 is mounted to the receiving space 300 of the shielding shell 4, a gap 601 is formed between an inner surface of the shielding shell top wall 41 and an outer surface of the base part rear portion 132. The rear sealing element 5 is formed in place by applying and solidifying suitable material through the gap 601.

What is claimed is:

1. An electrical connector comprising:

an insulative housing having a base and a tongue;

upper and lower rows of contacts arranged in the insulative housing and exposed respectively to upper and lower surfaces of the tongue, each row of contacts including an outermost ground contact, the ground contact in the lower row having a contacting portion, a tail portion, and an intermediate portion between the contacting portion and the tail portion, the ground contact in the upper row having a front contacting portion and a rear portion but lacking a tail portion;

a metallic element arranged between the upper row of contacts and the lower row of contacts; and a shielding shell enclosing the insulative housing; wherein the ground contact in the upper row and the ground contact in the lower row are in contact with the metallic element; and the ground contact in the upper row is in electrical connection with the tail portion of the ground contact in the lower row through the metallic element.

2. The electrical connector as claimed in claim 1, wherein:

the metallic element comprises a first plate in contact with the ground contacts and a separate second plate;

each row of contacts includes a power contact next to an associated ground contact, the power contact in the lower row having a contacting portion, a tail portion, and an intermediate portion between the contacting portion and the tail portion;

the power contact in the upper row and the power contact in the lower row are in touch with the second plate; and the power contact in the upper row and the power contact in the lower row share same tail portion of the power contact in the lower row.

3. The electrical connector as claimed in claim 2, wherein:

each row of contacts includes plural signal contacts each signal contact having a contacting portion, a tail portion, and an intermediate portion between the contacting portion and the tail portion;

a distance between the tail portions of the ground contact and the associated power contact in the lower row is greater than a distance between the tail portions of two adjacent signal contacts.

4. An electrical connector comprising:

an insulative housing including a base, and a tongue extending forwardly from the base in a front-to-back direction and defining upper and lower mating surfaces opposite to each other in a vertical direction perpendicular to said front-to-back direction;

a plurality of upper contacts and a plurality of lower contacts retained in the housing, each of most said upper contacts and said lower contacts including a front contacting section and a rear soldering section, the contacting sections of the upper contacts being exposed upon the upper mating surface while the contacting sections of the lower contacts being exposed upon the lower mating surface, the soldering sections of the upper contacts and those of the lower contacts being exposed rearwardly outside of the housing and arranged in one row along a transverse direction perpendicular to both said vertical direction and said front-to-back direction;

the contacting sections of some of the upper contacts and those of the corresponding ones of the lower contacts being paired with corresponding metallic plates intimately sandwiched therebetween in the vertical direction, respectively; wherein in each paired upper contact and lower contact with the corresponding metallic plate therebetween, only one of said paired upper contact and lower contact has the corresponding soldering section while the other has not.

5. The electrical connector as claimed in claim 4, wherein in each paired upper contact and lower contact with the corresponding metallic plate therebetween, only the lower contact has the soldering leg while the upper contact has not.

6. The electrical connector as claimed in claim 4, wherein the paired upper contact and lower contact are located at an outermost position of the housing in the transverse direction for grounding.

7. The electrical connector as claimed in claim 6, wherein another paired upper contact and lower contact for power delivery are located inside of said outermost position of the housing in the transverse direction.

8. The electrical connector as claimed in claim 7, wherein the soldering section of said another paired upper contact and lower contact for power delivery is offset toward the soldering section of said paired upper contact and lower contact for grounding in the transverse direction so as to facilitate arrangement of the soldering sections of the upper contacts and those of the lower contacts in said one row along the transverse direction.

9. The electrical connector as claimed in claim 4, wherein the paired upper contact and lower contact are located inside of an outermost position of the housing in the transverse direction for power delivery.

10. The electrical connector as claimed in claim 4, wherein in each paired upper contact and lower contact with the corresponding metallic plate therebetween, the whole contacting section of the upper contact and the whole contacting section of the lower contact intimately abut against the corresponding metallic plate in the vertical direction.

11. An electrical connector comprising:

an insulative housing including a base, and a tongue extending forwardly from the base in a front-to-back direction and defining upper and lower mating surfaces opposite to each other in a vertical direction perpendicular to said front-to-back direction;

a plurality of upper contacts and a plurality of lower contacts retained in the housing, each of most said upper contacts and said lower contacts including a front contacting section and a rear soldering section, the contacting sections of the upper contacts being exposed upon the upper mating surface while the contacting sections of the lower contacts being exposed upon the lower mating surface, the soldering sections of the upper contacts and those of the lower contacts being exposed rearwardly outside of the housing, said upper contacts including a plurality of power contacts and grounding contacts and said lower contacts including a plurality of power contacts and grounding contacts;

the contacting sections of two power contacts and two grounding contacts of the upper contacts and those of the corresponding ones of the lower contacts being paired with corresponding metallic plates intimately sandwiched therebetween in the vertical direction, respectively; wherein in each paired upper power contact and lower power contact with the corresponding metallic plate therebetween, only one of said paired upper power contact and lower power contact has the corresponding soldering section while the other lacks the corresponding soldering section; wherein in each paired upper grounding contact and lower grounding contact with the corresponding metallic plate therebetween, only one of said paired upper grounding contact and lower grounding contact has the corresponding soldering section while the other lacks the corresponding soldering section.

12. The electrical connector as claimed in claim 11, wherein the two power contacts and the two grounding contacts all lacking the corresponding soldering sections, are of the upper contacts.

* * * * *